US007380340B1

(12) United States Patent
Lerch

(10) Patent No.: US 7,380,340 B1
(45) Date of Patent: Jun. 3, 2008

(54) FOLDING TOOL WITH INLAY RELEASE

(76) Inventor: Matthew J. Lerch, N88 W23462 N. Lisbon Rd., Sussex, WI (US) 53089

( * ) Notice: Subject to any disclaimer, the term of this patent is extended or adjusted under 35 U.S.C. 154(b) by 471 days.

(21) Appl. No.: 11/132,582

(22) Filed: May 19, 2005

(51) Int. Cl.
*B26B 1/02* (2006.01)

(52) U.S. Cl. ..... 30/159; 30/160

(58) Field of Classification Search ..... 30/159, 30/160, 158
See application file for complete search history.

(56) References Cited

U.S. PATENT DOCUMENTS

| | | | | |
|---|---|---|---|---|
| 969,909 | A * | 9/1910 | Schrade | 30/159 |
| 4,535,539 | A * | 8/1985 | Friedman et al. | 30/161 |
| 4,947,552 | A * | 8/1990 | Barnes | 30/161 |
| 5,461,786 | A * | 10/1995 | Miller | 30/161 |
| 6,553,671 | B2 | 4/2003 | Blanchard | 30/161 |
| 7,107,686 | B2 * | 9/2006 | Linn et al. | 30/159 |
| 7,146,736 | B1 * | 12/2006 | Collins | 30/160 |
| 7,246,441 | B1 * | 7/2007 | Collins | 30/160 |
| 7,278,213 | B2 * | 10/2007 | Pardue et al. | 30/160 |
| 7,302,760 | B2 * | 12/2007 | Lake | 30/161 |
| 2003/0070299 | A1 * | 4/2003 | Frazer | 30/161 |

* cited by examiner

*Primary Examiner*—Ken Peterson
(74) *Attorney, Agent, or Firm*—Donald J. Ersler

(57) ABSTRACT

A folding tool with inlay release preferably includes a blade, a lock side plate, a release side plate, a cantilever spring and a release inlay. One end of the blade is pivotally retained between the lock side plate and the release side plate. One end of the cantilever spring is attached to the lock side plate and the other end is biased to contact the one end of the blade. A rocker bar is pivotally retained in the release side plate. One end of the rocker bar captures a biased end of the cantilever spring. The release inlay is used to pivot the other end of the rocker bar to release the one end of the rocker bar to allow the blade to be released from a closed position. A slide lock prevents the rocker bar from being released by the release inlay.

5 Claims, 4 Drawing Sheets

FOLDING TOOL WITH INLAY RELEASE

BACKGROUND OF THE INVENTION

1. Field of the Invention

The present invention relates generally to folding tools and more specifically to a folding tool with inlay release.

2. Discussion of the Prior Art

U.S. Pat. No. 6,553,671 to Blanchard discloses a folding knife with a button release locking liner. The Blanchard patent includes an improved folding knife having a handle with opposing first and second sides and a rotatable blade coupled with the handle and moveable between a locked position at which the blade extends from the handle and an unlocked position.

Accordingly, there is a clearly felt need in the art for a folding tool with inlay release, which allows the blade to be rotated manually or non-manually.

SUMMARY OF THE INVENTION

The present invention provides a folding tool with inlay release. The folding tool with inlay release (folding tool) preferably includes a blade, a blade spacer, a lock side plate, a release side plate, a cantilever spring and a release inlay. A side plate may be a liner or a frame. One end of the blade is pivotally retained by a pivot post. The pivot post is retained by at least one of the side plates. The blade spacer is retained between the lock side plate and the release side plate. One end of the cantilever spring is attached to the lock side plate and the other end is biased to contact the one end of the blade. A rocker bar is pivotally retained in the release side plate. One end of the rocker bar captures a biased end of the cantilever spring. The release inlay includes an actuation end that is used to pivot the other end of the rocker bar to release the one end of the rocker bar to allow the blade to be released from a closed position. A lock leaf is retained in the lock side plate. The lock leaf locks the blade in an open position and a closed position. A slide lock is slidably retained in one of the side plates. The slide lock prevents the rocker bar from being pivoted by the release inlay.

Accordingly, it is an object of the present invention to provide a folding tool, which allows the blade to be released by depressing a release inlay.

Finally, it is another object of the present invention to provide a folding tool, which includes a slide lock that prevents the blade from being released by depressing a release inlay.

These and additional objects, advantages, features and benefits of the present invention will become apparent from the following specification.

DETAILED DESCRIPTION OF THE PREFERRED EMBODIMENTS

Figure 1:
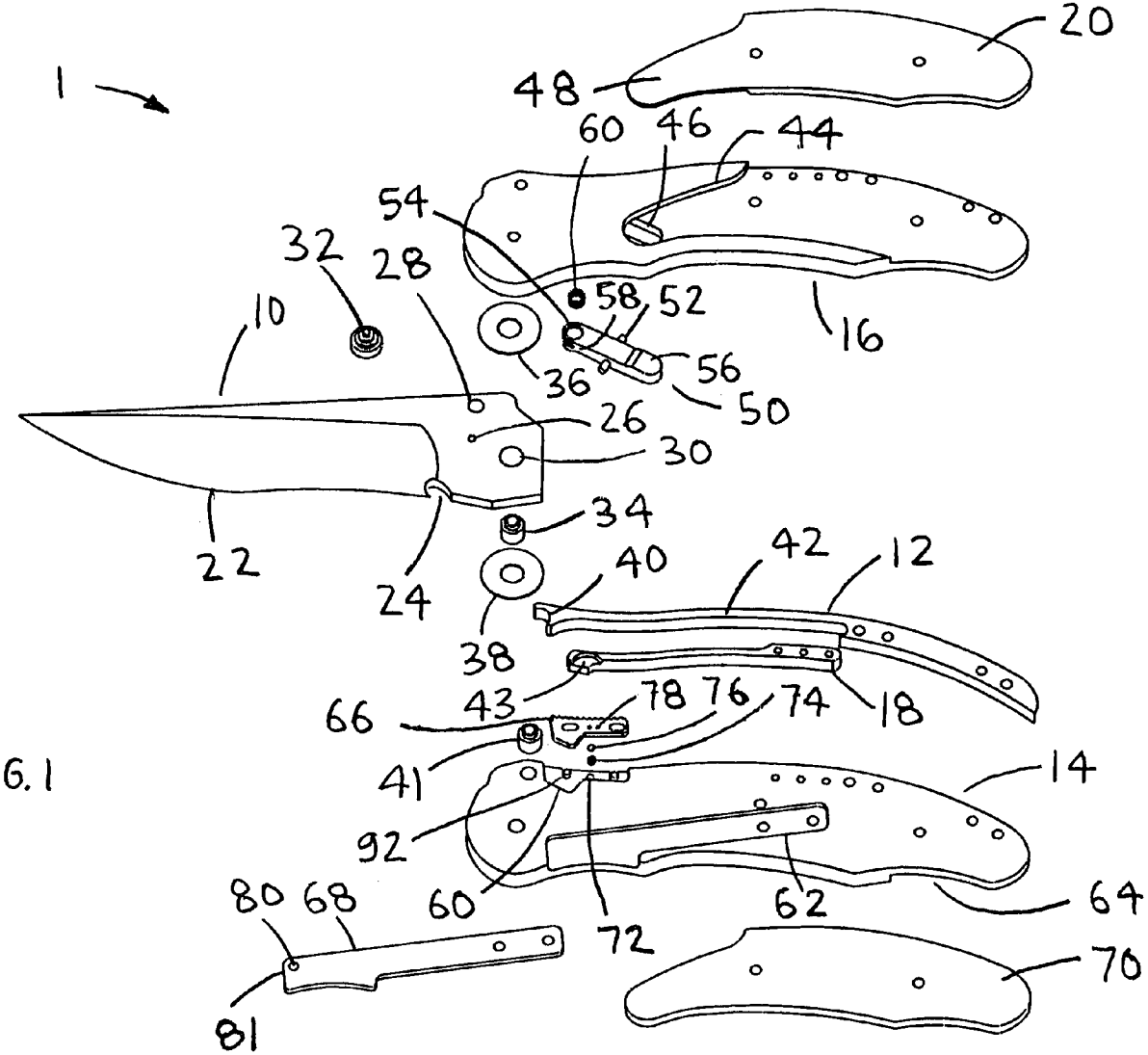
FIG. 1 is an exploded perspective view of a folding tool in accordance with the present invention.
Figure 2:
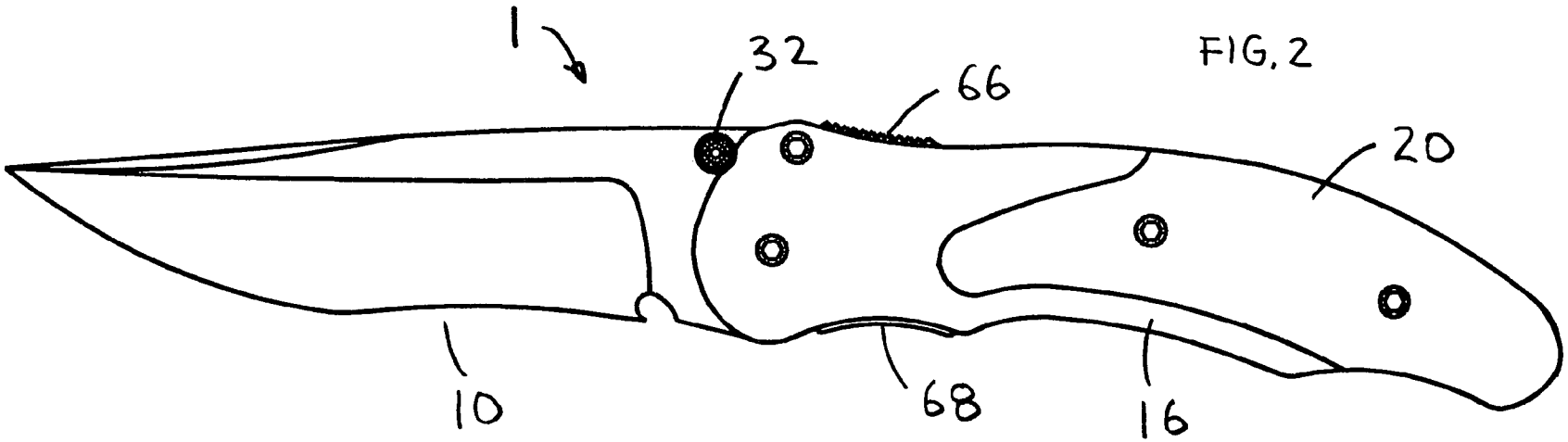
FIG. 2 is a front view of a folding tool with a blade in an open position in accordance with the present invention.
Figure 3:
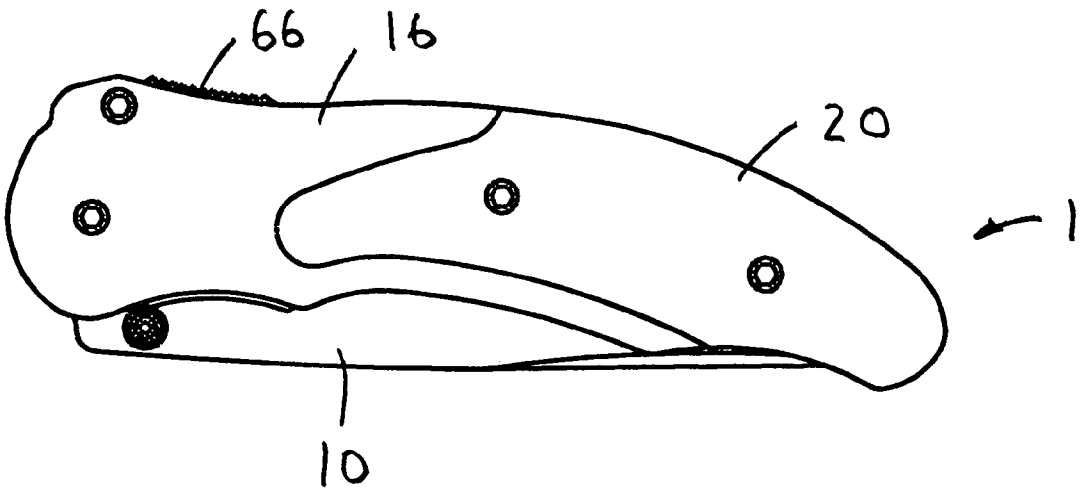
FIG. 3 is a front view of a folding tool with a blade in a closed position in accordance with the present invention.
Figure 4:
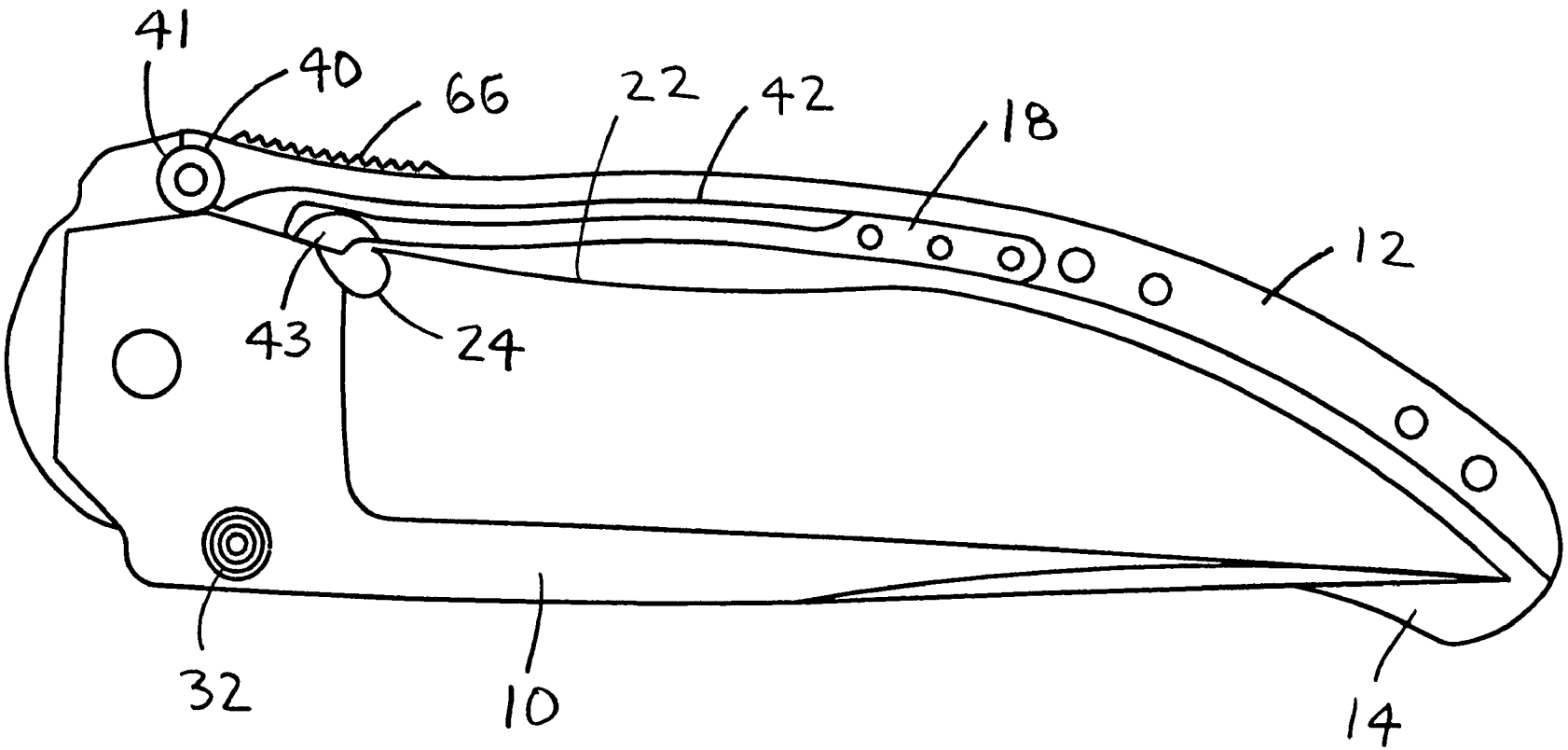
FIG. 4 is a front view of a folding tool with a blade in a closed position with a release side plate removed in accordance with the present invention.

With reference now to the drawings, and particularly to FIG. 1, there is shown an exploded perspective view of a folding tool 1. With reference to FIGS. 2-6, the folding tool 1 preferably includes a blade 10, a blade spacer 12, a lock side plate 14, a release side plate 16, a cantilever spring 18 and a release inlay 20. The blade 10 preferably includes at least one cutting edge 22, a sharpening relief 24, a lock hole 26, thumb stud hole 28 and a pivot hole 30. The at least one cutting edge 22 is formed along a length of the blade 10. The sharpening relief 24 is formed adjacent one end of the cutting edge 22. The lock hole 26 is formed in one end of the blade 10. The thumb stud hole 28 is formed adjacent one side of the lock hole 26 and the pivot hole 30 is formed through the opposite side of the lock hole 26.

A thumb stud 32 is pressed into the thumb stud hole 28. A pivot post 34 is sized to be pivotally received by the pivot hole 30. One end of the pivot post 34 is preferably retained by the lock side plate 14 and the other end by the release side plate 16. A first pivot washer 36 is retained by one end of the pivot post 34 and placed between the release side plate 16 and one side of the blade 10. A second pivot washer 38 is retained by the other end of the pivot post 34 and placed between the lock side plate 14 and the other side of the blade 10. The blade spacer 12 preferably includes a location arc 40 and a spring slot 42. The location arc 40 is formed in one end of the blade spacer 12. The location arc 40 is sized to receive a location pin 41. The location pin 41 is preferably retained by the lock side plate 14 and the release side plate 16. The spring slot 42 is formed along a portion of the length of the blade spacer 12. The spring slot 42 is sized to receive the cantilever spring 18. The other end of the blade spacer 12 is retained between the lock side plate 14 and the release side plate 16 with suitable fasteners.

One end of the cantilever spring 18 is preferably retained between the lock side plate 14 and the release side plate 16 with suitable fasteners. The other end of the cantilever spring 18 is biased away from the blade spacer 12 toward the one end of the blade 10. A clearance pocket 43 is formed on the other end of the cantilever spring 18. The release side plate 16 includes a release inlay pocket 44 and a rocker pocket 46. The release inlay pocket 44 is sized to receive the release inlay 20. An actuation end 48 of the release inlay 20 includes a reduced thickness to allow thereof to be flexed. The release inlay 20 is preferably retained in the release inlay pocket 44 with suitable fasteners.

A rocker bar 50 includes a pivot rod 52, a spring pocket 54, a contact pad 56 and a lock slot 58. The pivot rod 52 is pressed through a hole in substantially a center of the rocker bar 50. The spring pocket 54 is formed on one end of the rocker bar 50 and the contact pad 56 is formed on the other end thereof. The spring pocket 54 is sized to receive a first compression spring 60. The lock slot 58 is formed below the spring pocket 54. The clearance pocket 43 in the cantilever spring 18 is sized to receive a perimeter of the one end of the rocker bar 50. The lock side plate 14 includes a slide pocket 60, a lock leaf pocket 62 and a lock inlay pocket 64. The slide pocket 60 is formed in one end of the lock side plate 14 at a top thereof to slidably receive a slide lock 66. The lock leaf pocket 62 is formed in substantially a bottom of the lock side plate 14. The lock leaf pocket 62 is sized to receive a lock leaf 68. The lock inlay pocket 64 is formed on the opposite side of the lock side plate 14. The lock inlay pocket 64 is sized to receive a lock inlay 70. The lock inlay 70 is preferably retained in the lock inlay pocket 64 with suitable fasteners.

A ball hole 72 is formed in the lock pocket 60 to receive a ball spring 74 and a lock ball 76. A top of the ball hole 72 is peened around the perimeter to retain the ball spring 74 and the lock ball 76. Two location holes 78 are formed through the slide lock 66 to receive the lock ball 76. A locking projection 80 is formed on one end of the lock leaf 68 and the other end is retained in the lock leaf pocket 62 with suitable fasteners. The locking projection 80 is sized to be received by the lock hole 26 formed in the one end of the blade 10. The locking projection 80 retains the blade 10 in a closed position. An edge 81 of the locking bar 68 retains the blade 10 in an open position.

The rocker bar 50 is pivotally retained in the release side plate 14 by forming two in-line rod pockets 82 in the release side plate 14, perpendicular to the rocker bar pocket 46. The two in-line rod pockets 82 are sized to receive the pivot rod 52 extending from both sides of the rocker bar 50. The rocker bar 50 is preferably pivotally retained in the rocker bar pocket 46 by threading two fasteners 84 into a pair of threaded holes 86 formed in the release side plate 16. The slide lock 66 includes a pair of oval slots 88 and a serrated top edge 90. Each oval slot 88 is sized to receive a slide pin 92. Each slide pin 92 is pressed into the lock side plate 14. The slide lock 66 is slid from a first position as defined by one of the two location holes 78 and a second position as defined by the other location hole 78. The rocker bar 50 is pivoted by fully depressing the actuation end 48 of the release inlay 20.

Figure 5:
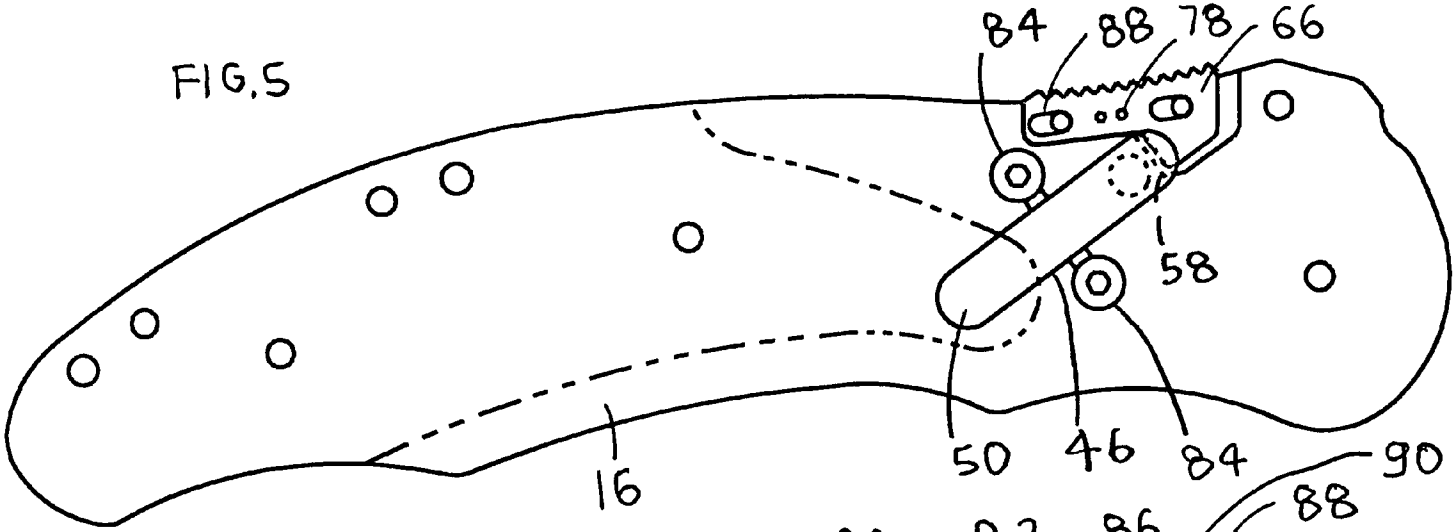
FIG. 5 is a rear view of a release side plate with a slide lock locking a rocker bar of a folding tool in accordance with the present invention.
Figure 6:
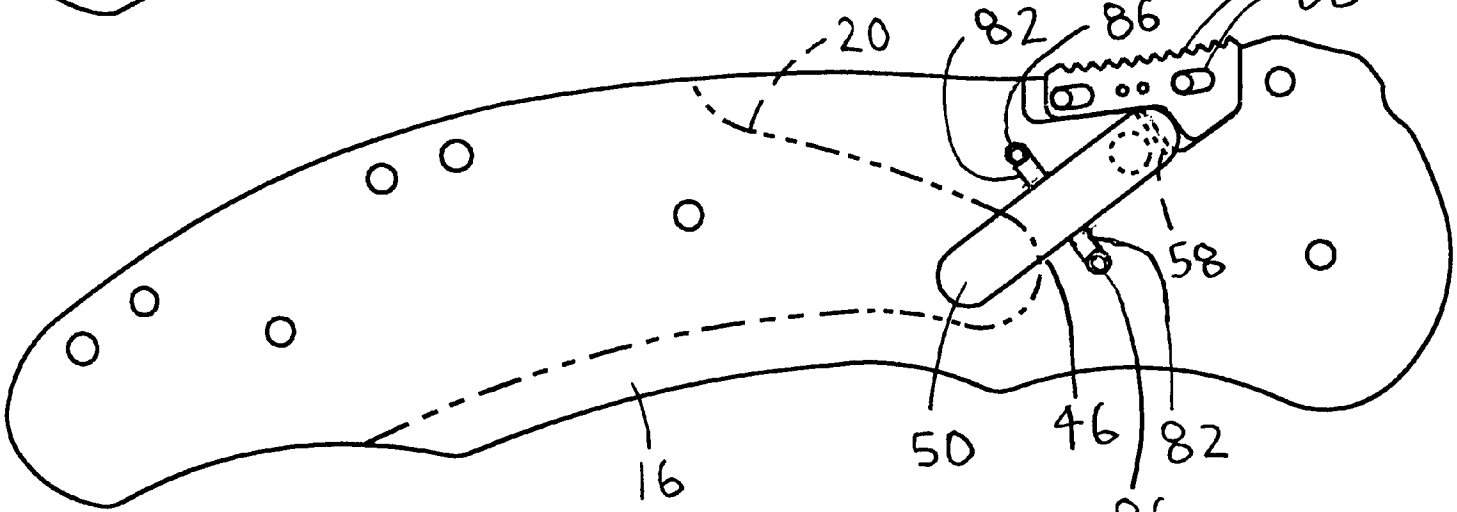
FIG. 6 is a rear view of a release side plate with a slide lock not locking a rocker bar of a folding tool in accordance with the present invention.

Pivoting the rocker bar 50 removes the one end of the rocker bar 50 from the clearance pocket 43 of the cantilever spring 18. Removing the rocker bar 50 from the clearance pocket allows the cantilever spring 18 to move toward the one end of the blade 10 and push the blade 10 into an open position from a closed position. FIG. 5 shows the slide lock 66 in a first position that only allows the blade 10 to be manually placed in an open position. The lock ball 76 is seated in the first location hole 78 and removably retains the slide lock 66 in the first position. A portion of the slide lock 66 is retained in the lock slot 58 to prevent the rocker bar 50 from pivoting. The blade 10 is preferably moved from a closed position to an open position with the thumb stud 32. FIG. 6 shows the slide lock 66 in a second position that allows the blade 10 to be released from the closed position to the open position when the actuation end 48 is fully depressed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of transferring a blade from a closed position to an open position, comprising the steps of:

connecting pivotally one end of a blade to at least one of a lock side plate and a release side plate;

providing a rocker bar that is pivotally retained by one of said side plates;

biasing one end of a cantilever spring toward said one end of said blade, restraining said one end of said cantilever spring with one end of said rocker bar, said one end of said rocker bar being biased against said cantilever spring with a spring; and releasing said cantilever spring by actuating the other end of said rocker bar with a flexible end of a release inlay, said flexible end of said release inlay being separately moveable from said rocker bar, releasing said cantilever spring causing said blade to move from a closed position to an open position.

2. The method of transferring a blade from a closed position to an open position of claim 1, further comprising the step of:

locking said rocker bar to prevent said blade from being released from a closed position by inserting a slide lock into a lock slot in said rocker bar.

3. The method of transferring a blade from a closed position to an open position of claim 1, further comprising the step of:

retaining pivotally said rocker bar in said release side plate.

4. The method of transferring a blade from a closed position to an open position of claim 1, further comprising the step of:

retaining said release inlay in said release side plate, actuating the other end of said rocker bar by depressing an actuating end of said release inlay.

5. The method of transferring a blade from a closed position to an open position of claim 1, further comprising the step of:

retaining a lock leaf in said lock side plate, said lock leaf including a locking projection, a lock hole being formed in said one end of said blade to receive said locking projection, said locking projection retaining said blade in a closed position.

* * * * *